US012534170B2

(12) United States Patent
Matsumoto et al.

(10) Patent No.: US 12,534,170 B2
(45) Date of Patent: Jan. 27, 2026

(54) OUTBOARD MOTOR

(71) Applicant: HONDA MOTOR CO., LTD., Tokyo (JP)

(72) Inventors: Takuya Matsumoto, Saitama (JP); Ryohei Matsuoka, Saitama (JP)

(73) Assignee: HONDA MOTOR CO., LTD., Tokyo (JP)

( * ) Notice: Subject to any disclaimer, the term of this patent is extended or adjusted under 35 U.S.C. 154(b) by 446 days.

(21) Appl. No.: 18/189,754

(22) Filed: Mar. 24, 2023

(65) Prior Publication Data

US 2024/0317376 A1 Sep. 26, 2024

(51) Int. Cl.
*B63H 20/10* (2006.01)
*B63H 20/06* (2006.01)
*B63H 20/32* (2006.01)

(52) U.S. Cl.
CPC ..... *B63H 20/10* (2013.01); *B63H 20/06* (2013.01); *B63H 20/32* (2013.01)

(58) Field of Classification Search
CPC ..... B63H 20/10; B63H 20/06; B63H 20/32
See application file for complete search history.

(56) References Cited

U.S. PATENT DOCUMENTS 3,610,198 A * 10/1971 Alexandrowicz ..... F02M 35/10262 123/195 P
5,445,547 A * 8/1995 Furukawa ..... F02B 61/045 440/88 R
2003/0054708 A1* 3/2003 Yoshioka ..... B63H 20/08 440/53

FOREIGN PATENT DOCUMENTS

JP 4735607 B2 7/2011

* cited by examiner

*Primary Examiner* — Stephen P Avila
(74) *Attorney, Agent, or Firm* — Armstrong Teasdale LLP

(57) ABSTRACT

An outboard motor, comprises a housing main body (34) configured to be attached to a hull (14) of watercraft so as to be tilted upward, a propulsion device (32) attached to a lower part of the housing main body, a lower case (35) provided on an upper part of the housing main body, an upper cover (36) fixed to the lower case and defining a motor chamber jointly with the lower case, a motor (22) received in the motor chamber and configured to drive the propulsion device, and an outer shell (38) at least partly covering the upper cover, wherein the upper cover is provided with a grip portion (72) for the outboard motor, and the outer shell is provided with an opening (86) that permits access to the grip portion.

10 Claims, 7 Drawing Sheets

OUTBOARD MOTOR

TECHNICAL FIELD

The present invention relates to an outboard motor, and in particular to an outboard motor having an improved grip portion for tilting up the outboard motor.

BACKGROUND ART

In case of an outboard motor which is configured to be manually tilted up, a grip portion is provided on an outer shell of the outboard motor which may also be referred to as a cover or an outer case. JP4735607B2 discloses an outboard motor provided with a grip portion that can be used for tilting up the outboard motor.

When tilting up the outboard motor, the load due to the weight of the outboard motor is applied to the outer shell, and such a part is required to have an adequate mechanical rigidity and strength. As a result, the outer shell is required to be firmly attached to the housing main body, and this requires a large number of fasteners to attach the outer shell to a housing main body or a lower case which is in turn attached to the housing main body.

For the ease of maintenance, it is desirable for the outer shell to be easily detachable, and to require as small a number of fasteners as possible. In terms of external appearance, the number of visible fasteners is desired to be minimized. Further, the presence of a grip portion protruding from the outboard motor is not desirable from aesthetic view point.

SUMMARY OF THE INVENTION

In view of such a problem of the prior art, a primary object of the present invention is to provide an outboard motor which is fitted with a grip portion for tilt-up having an adequately high mechanical strength and mechanical rigidity, and can be maintained and serviced with ease.

To achieve such an object, the present invention provides an outboard motor, comprising: a housing main body (34) configured to be attached to a hull (14) of watercraft so as to be tilted upward; a propulsion device (32) attached to a lower part of the housing main body; a lower case (35) provided on an upper part of the housing main body; an upper cover (36) fixed to the lower case and defining a motor chamber jointly with the lower case; a motor (22) received in the motor chamber and configured to drive the propulsion device; and an outer shell (38) at least partly covering the upper cover, wherein the upper cover is provided with a grip portion (72) for the outboard motor, and the outer shell is provided with an opening (86) that permits access to the grip portion.

Thereby, an adequate mechanical rigidity and strength can be provided to the grip portion, and the outer shell provides an aesthetically favorable external appearance. Since the upper cover, which may be largely concealed from external view, can be formed as a highly rigid member, the upper cover can be adequately firmly attached to the lower case by using a relatively small number of fasteners. Thereby, the maintenance and servicing of the motor and other components in the motor chamber can be facilitated.

Preferably, in this outboard motor, the upper cover is provided with a bulge (36A) that bulges upward in a part thereof corresponding to the motor, and a shelf (76) extending rearward from a rear end part of the bulge to serve as the grip portion.

The shelf thus forms the grip portion that allows the outboard motor to be tilted up by being lifted upward.

Preferably, in this outboard motor, an upper surface of the shelf is substantially at a same elevation as an upper surface of the bulge.

Thereby, the outer shell that closely covers the bulge and the shelf can extend in a substantially planar configuration so that the external appearance of the outer shell can be improved.

Preferably, in this outboard motor, a rib extends from a front end part of the shelf and a rear end part of the bulge.

Thereby, the mechanical strength of the shelf is increased, and the necessary thickness of the shelf can be reduced.

Preferably, in this outboard motor, the rib is one of a plurality of ribs extending vertically and in a fore and aft direction in a laterally spaced apart relationship, the laterally outermost ribs being longer in the fore and aft direction than the remaining ribs.

Thereby, the mechanical strength of the shelf can be effectively increased.

Preferably, in this outboard motor, the rib has an upper edge which is substantially at a same elevation as an upper surface of the bulge.

Thereby, the size of the rib can be maximized while maintaining a smooth outer profile of the upper surface of the outer shell.

Preferably, in this outboard motor, the upper cover further includes a lower wall portion extending substantially horizontally under the shelf in a spaced relationship to the shelf, and the lower wall portion extends rearward beyond a rear edge of the shelf.

Thereby, the fingertips of the user are guided by the lower wall portion, and the user is enabled to grip the shelf in a comfortable manner.

Preferably, in this outboard motor, the lower wall portion is continuously and smoothly connected to an outer profile of a part of the outer shell adjacent to the lower wall portion.

Thereby, the external appearance of the outboard motor can be made highly attractive.

Preferably, in this outboard motor, the upper cover is provided with a front wall (74) extending substantially vertically downward from a front edge of the shelf, and a pair of side walls (80) extending substantially vertically downward from either side edge of the shelf, the front wall and each side wall being connected by an oblique wall (80A).

Thereby, stress concentration can be avoided, and the mechanical strength of the shelf serving as the grip portion can be increased.

Preferably, in this outboard motor, an operation panel including a push-button is provided on the upper cover.

Owing to the increased rigidity of the upper cover, the mounting stiffness of the operation panel can be increased, and the operability of the push-button can be improved. The outer shell may be provided with an opening for exposing the operation panel.

Preferably, in this outboard motor, the grip portion is positioned behind a gravitational center of the outboard motor.

Thereby, the outboard motor can be tilted up with a comparatively small force owing to a lever action.

The present invention thus provides an outboard motor which is fitted with a grip portion for tilt-up having an adequately high mechanical strength and mechanical rigidity, and can be maintained and serviced with ease.

BRIEF DESCRIPTION OF THE DRAWING(S)

DESCRIPTION OF THE PREFERRED EMBODIMENT(S)

An outboard motor according to an embodiment of the present invention will be described in the following with reference to the appended drawings.

Figure 1:
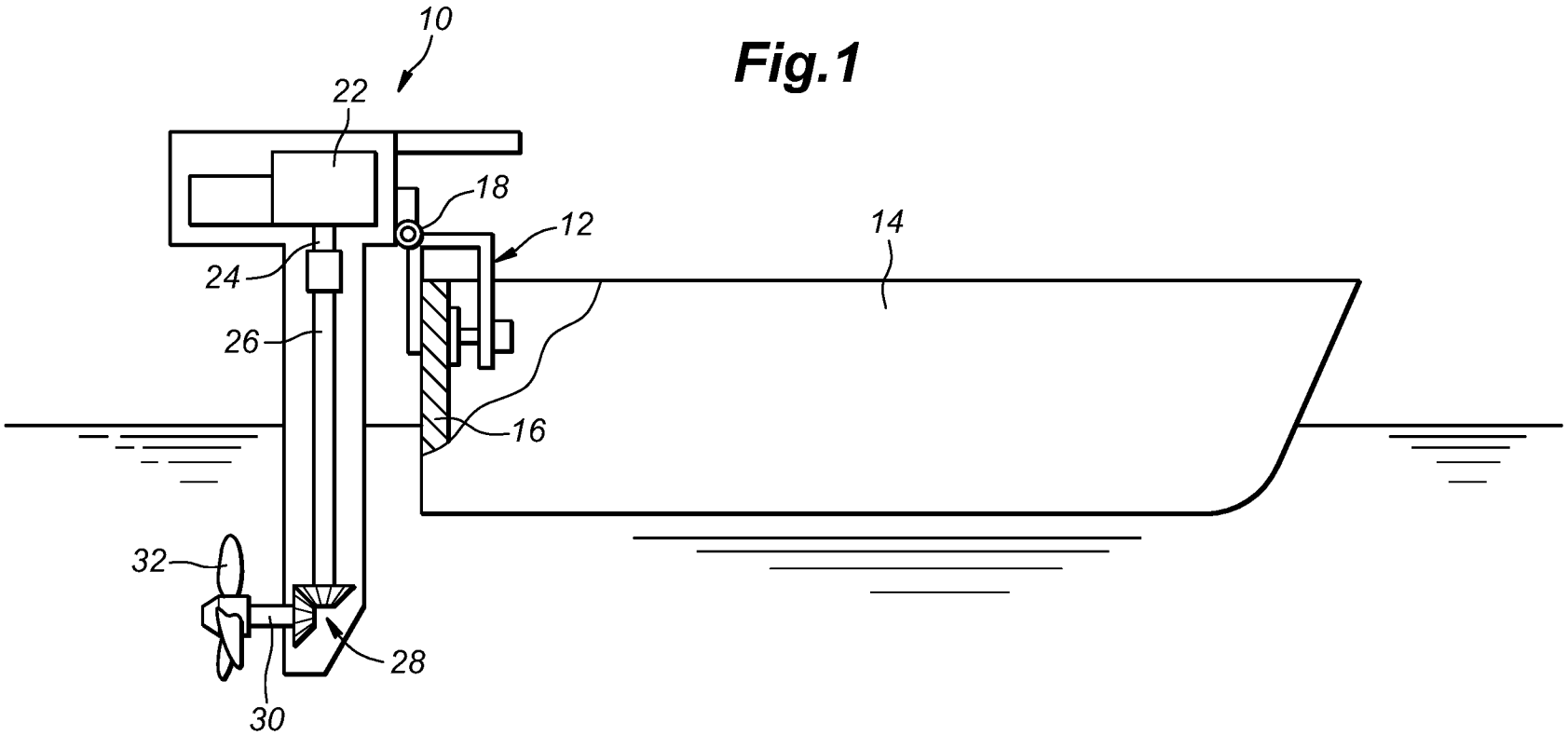
FIG. 1 is a simplified side view of watercraft equipped with an outboard motor according to an embodiment of the present invention.

FIG. 1 shows watercraft in the form of a boat equipped with an outboard motor 10 of the present embodiment. The outboard motor 10 is mounted on the transom 16 of the hull 14 via a clamping mechanism 12 so as to be tiltable around a lateral tilt axis 18 as well as to be laterally steerable in a per se known manner. The outboard motor 10 is of an electric type, and has an electric motor 22 having a vertically extending output shaft 24 as a prime mover. The output shaft 24 is connected to a vertically extending drive shaft 26, and the lower end of the drive shaft 26 is connected to a propeller shaft 30 which supports a propeller 32 via a gear mechanism 28.

Figure 2:
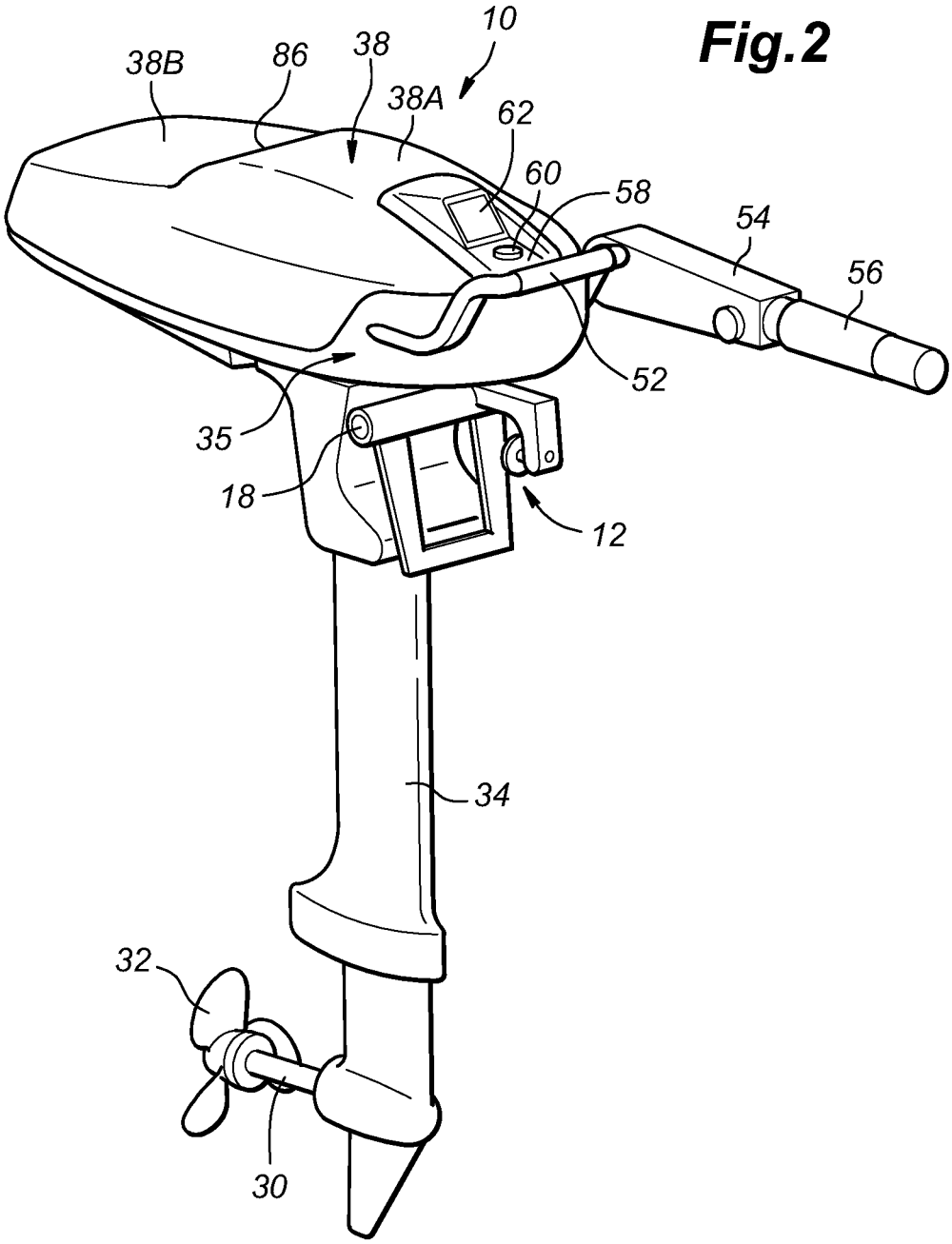
FIG. 2 is a perspective view of the outboard motor.
Figure 3:
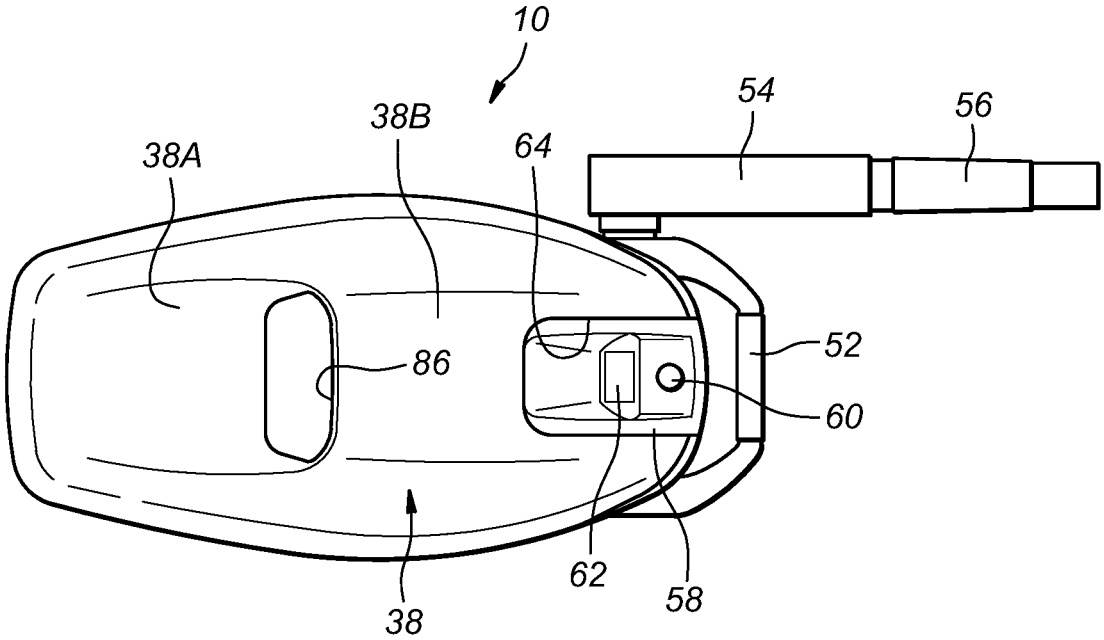
FIG. 3 is a top view of the outboard motor.

FIGS. 2 and 3 are external views of the outboard motor 10. The outboard motor 10 is provided with a housing main body 34 that extends vertically and receives the drive shaft 26 therein. The propeller shaft 30 extends rearward from a lower end part of the housing main body 34, and a lower case 35 having an open top end is supported by an upper end part of the housing main body 34. A grip handle 52 is attached to the front end of the lower case 35, and a tiller handle 54 is attached to a front left part of the lower case 35. The free end of the tiller handle 54 is provided with a throttle grip 56.

An upper cover 36 (FIGS. 4 to 6) is attached to the lower case 35 as will be described hereinafter, but is covered by an outer shell 38 so that the upper cover 36 is substantially concealed from external view. An operation panel 58 is attached to the upper cover 36, so as to be visible from outside. The operation panel 58 is provided with a push-button 60 and a display unit 62.

Figure 4:
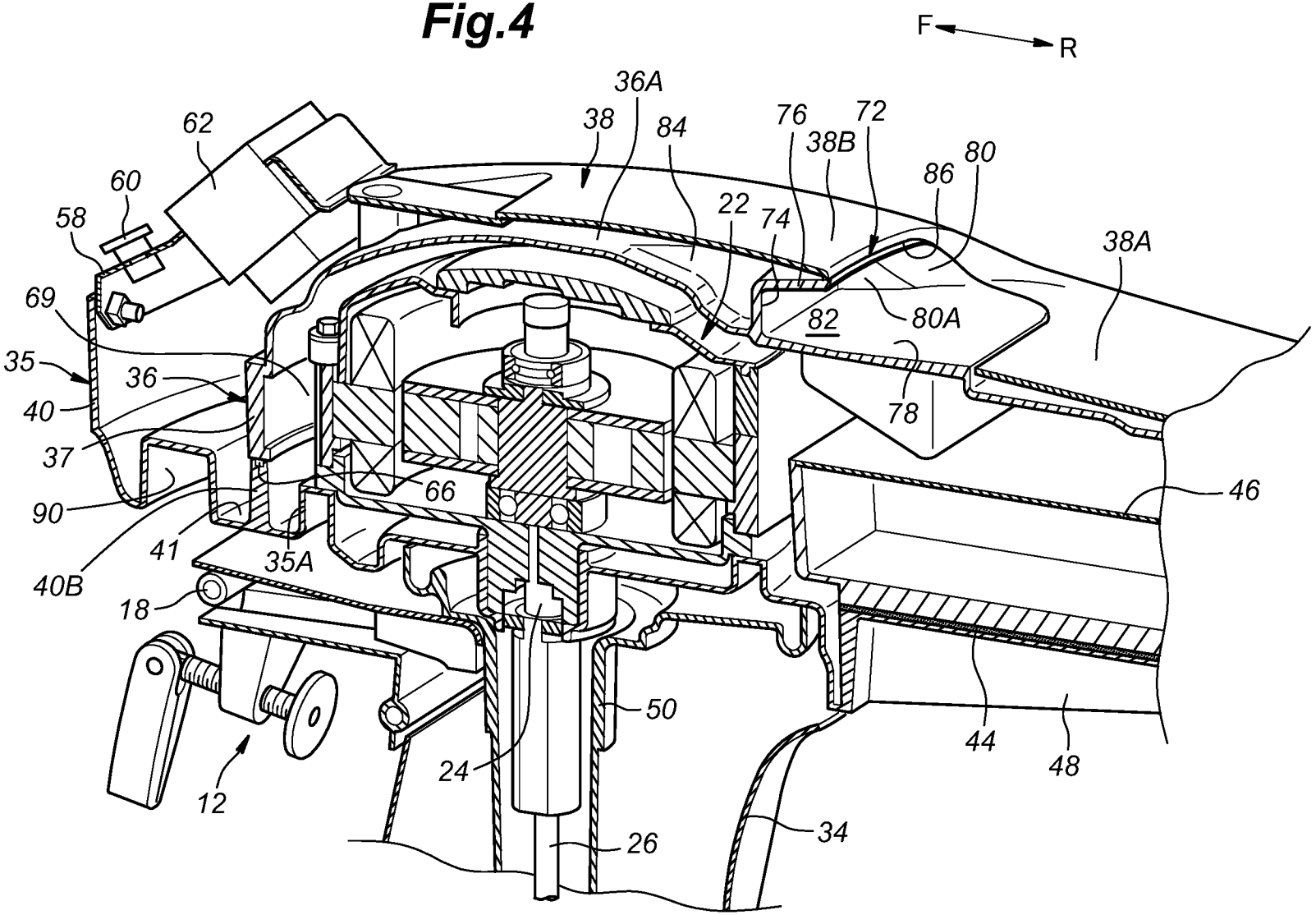
FIG. 4 is a fragmentary sectional perspective view of an upper part of the outboard motor.
Figure 5:
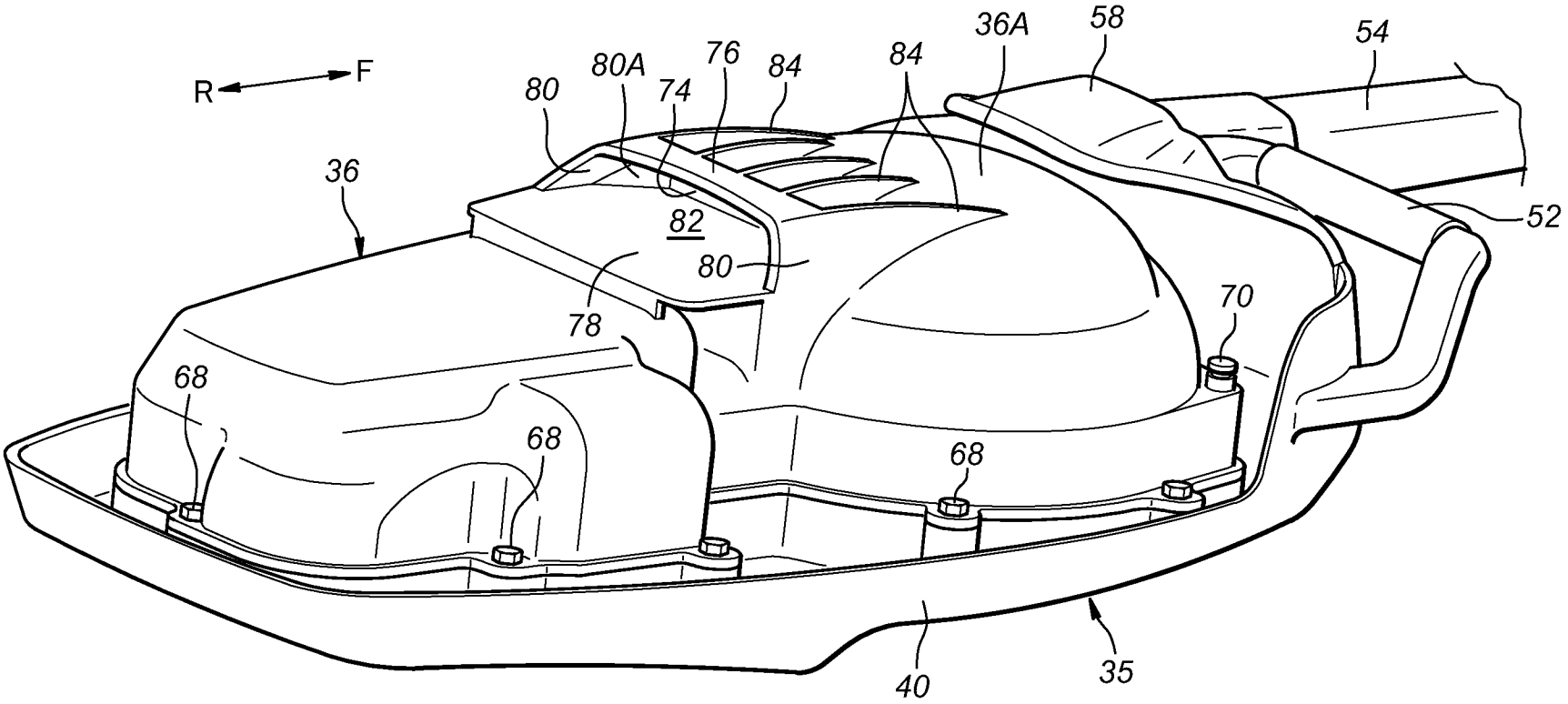
FIG. 5 is a perspective view of the lower case and the upper cover of the outboard motor.
Figure 6:
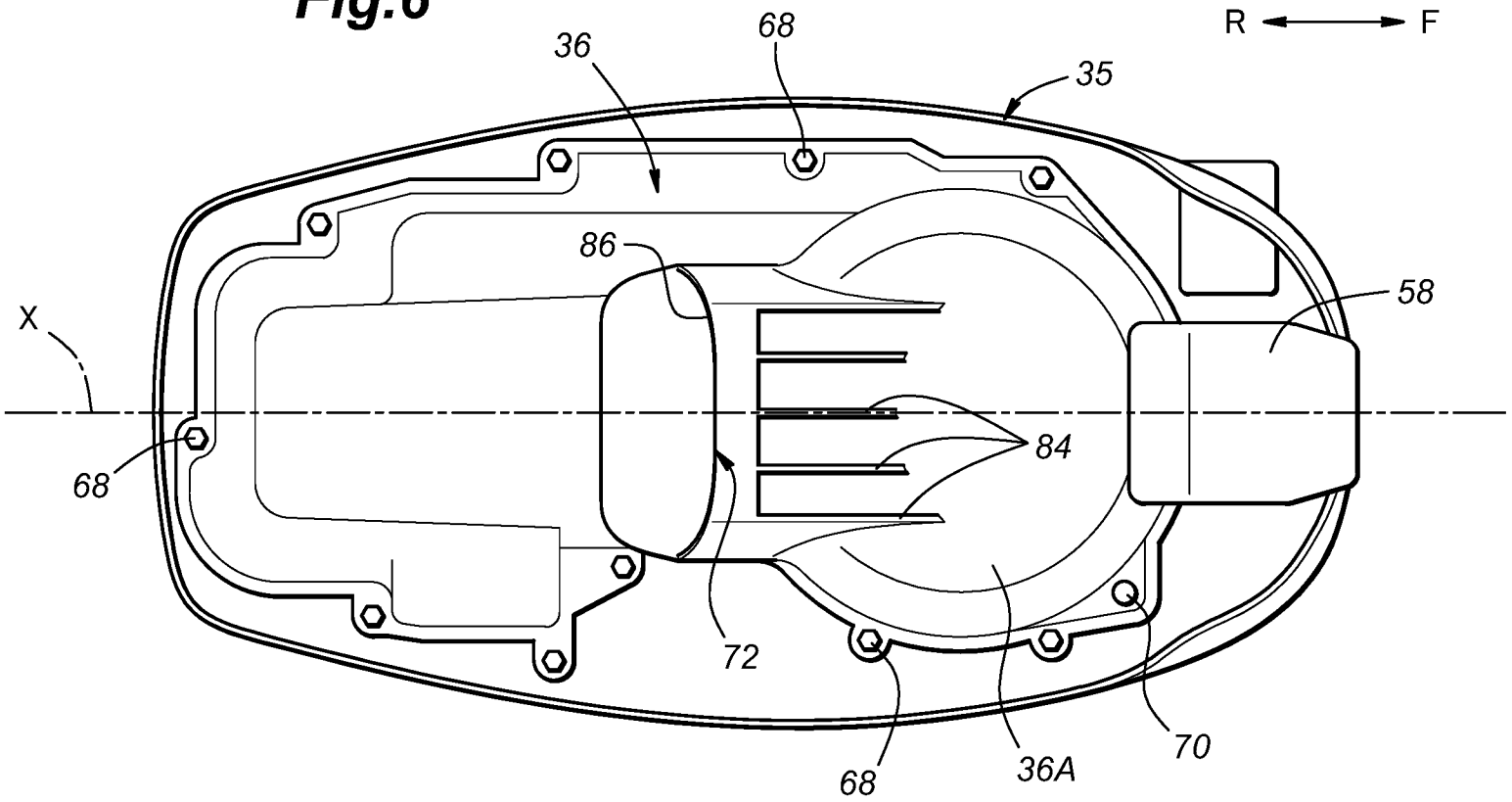
FIG. 6 is a top view of the upper case partly in section.

FIGS. 4 to 6 show the internal structure of an upper part of the outboard motor 10. The lower case 35 supports the electric motor 22 via an annular projection 35A formed in the lower case 35, and is provided with a central tubular portion 50 through which the output shaft 24 of the electric motor 22 extends. The outer periphery of the lower case 35 forms a tray part 41 surrounded by a peripheral wall 40 extending upward. The upper cover 36 is provided with a side wall 37 whose lower end abuts against an upright wall 40B formed in the tray part 41 via a seal member 66.

The upper cover 36 is fitted on the lower case 35, and is fastened thereto by a plurality of screws 68. The upper cover 36 and the lower case 35 jointly define a motor chamber 69 accommodating the electric motor 22 and associated component parts. The upper cover 36 is provided with a breather port 70 for ventilating the motor chamber 69.

A front end part of the upper cover 36 defines a bulge 36A bulging upward and having a substantially circular outer periphery accommodating an upper end of the electric motor 22. In the illustrated embodiment, the bulge 36A is provided with a part-spherical outer profile. The upper cover 36 further includes a front wall 74 projecting vertically upward from a front end part of the bulge 36A, a shelf 76 extending substantially horizontally rearward from the upper end of the front wall 74, a lower wall portion 78 extending substantially horizontally rearward from a lower end of the front wall 74, and a pair of side walls 80 extending upright from the lower wall portion 78 to the respective side edges of the shelf 76. The front wall 74 is connected to each side wall 80 via an oblique wall 80A such that the joint between the front wall 74 and the side wall 80 is rounded or chamfered in top view.

Thus, a cavity 82 which opens rearward is defined by the front wall 74, the side walls 80, the shelf 76 and the lower wall portion 78. Owing to the oblique walls 80A, the cavity 82 gets laterally narrower toward the front or toward the deeper part of the cavity 82. The lower wall portion 78 extends substantially horizontally rearward some distance beyond the rear edge of the shelf 76. Thus, a grip portion 72 is formed by the shelf 76 for tilting up the outboard motor 10. The lower wall portion 78 serves as a guide portion for the fingertips of the user who is about to grip the shelf 76 from below to raise the rear part of the outboard motor 10. The distance between the shelf 76 and the lower wall portion 78 is dimensioned so as to receive the fingers of the user without causing discomfort to the user.

A plurality of ribs 84, or five ribs 84 in the illustrated embodiment, extend between the rear end of the bulge 36A and the front wall 74. The ribs 84 extend vertically and in the fore and aft direction, and have upper edges extending substantially at a same elevation as the upper part of the bulge 36A. The upper surface of the shelf 76 also extends substantially at a same elevation as the upper edges of the ribs 84. Owing to the spherical shape of the bulge 36A, the two outer ribs 84 are longer in the fore and aft direction than the remaining ribs 84.

The space jointly defined by the upper cover 36 and the lower case 35 behind the motor chamber 69 accommodates a PDU case 46 which houses power control devices, and a heat sink 48 is attached to the lower side of the PDU case 46 via a heat conductive layer 44. The lower side of the heat sink 48 is provided with fins, and is exposed to the atmosphere.

The outer shell 38 which is made of a relatively thin plastic sheet and provided with an aesthetically attractive appearance generally covers the upper cover 36 and the lower case 35. The lower peripheral edge of the outer shell 38 abuts against the upper peripheral edge of the lower case 35 so as to jointly define a smooth outer profile of the upper part of the outboard motor 10. The outer shell 38 may be attached to the upper cover 36 and the lower case 35 via resilient tabs and a small number of screws so as not to detract from the external appearance of the outboard motor 10. The outer shell 38 is provided with a first opening 86 that exposes the cavity 82 defined between the shelf 76 and the lower wall portion 78, and a second opening 64 that exposes the operation panel 58 which is secured to the upper cover 36 and the lower case 35.

The upper cover 36 has an irregular outer surface owing to the need to cover irregularly shaped objects such as the electric motor 22 and the PDU case 46, and to be provided with ribs 84 for reinforcement. Further, the screws 68 protrude from the upper surface of the upper cover 36. However, since the outer shell 38 covers the outer profile of the upper cover 36, a favorable outer profile can be created by the outer shell 38. In this regard, the outer shell 38 may closely follow the outer contour of the upper cover 36 so as not to unduly increase the volume of the upper part of the outboard motor 10 on the one hand and to define a smooth outer contour of the upper part of the outboard motor 10 on the other hand.

In the present embodiment, as best shown in FIG. 2, the outer shell 38 includes a front half 38A having a relatively round profile, and a rear half 38B having a relatively flat top. The grip portion 72 is positioned at the boundary between the front half 38A and the rear half 38B of the outer shell 38. As a result, an aesthetically favorable appearance and a favorable functionality can be achieved at the same time.

When the outboard motor 10 is required to be tilted up, the user puts the fingertips into the cavity 82, and grips the lower surface of the shelf 76 to raise the rear part of the outboard motor 10. Since the opening of the cavity 82 faces rearward at the boundary between the front half 38A and the rear half 38B of the outer shell 38, the user is able to reach the cavity 82 with ease.

Since the shelf 76 which is required to withstand the force required to tilt up the outboard motor 10 is a part of the upper cover 36, instead of the outer shell 38, the shelf 76 can be given with an adequate mechanical strength with ease. Furthermore, the ribs 84 further reinforce the shelf 76.

Since the outer shell 38 is not required to withstand any significant load, it can be made of a thin plastic sheet or the like, and few fasteners are required for the attachment of the outer shell 38 to the upper cover 36 and/or the lower case 35. This contributes to a favorable external appearance of the outboard motor 10.

The lower wall portion 78 extends rearward beyond the rear edge of the shelf 76, and is connected to the rear end part of the upper cover 36 both continuously and smoothly. Thus, the upper cover 36 has a relatively tall front part and a relatively low rear part which substantially conform to the outer profile of the outer shell 38. In the illustrated embodiment, the lower wall portion 78 extends slightly beyond the rear edge of the shelf 76, and the rear end of the lower wall portion 78 is provided with a stepped portion such that the upper surface of the upper cover 36 immediately behind the lower wall portion 78 is slightly lower than the lower wall portion 78. The rear edge of the first opening 86 of the outer shell 38 abuts against a rear facing surface of the stepped portion so that the lower wall portion 78 is smoothly connected to the outer surface of the outer shell 38. This contributes to a favorable external appearance of the outboard motor 10.

Since the operation panel 58 is attached to the upper cover 36 having a high rigidity, the operation panel 58 is prevented from deforming or moving when the push-button 60 is pressed or the operation panel 58 is otherwise operated so that the operability of the operation panel 58 is improved.

Figure 7:
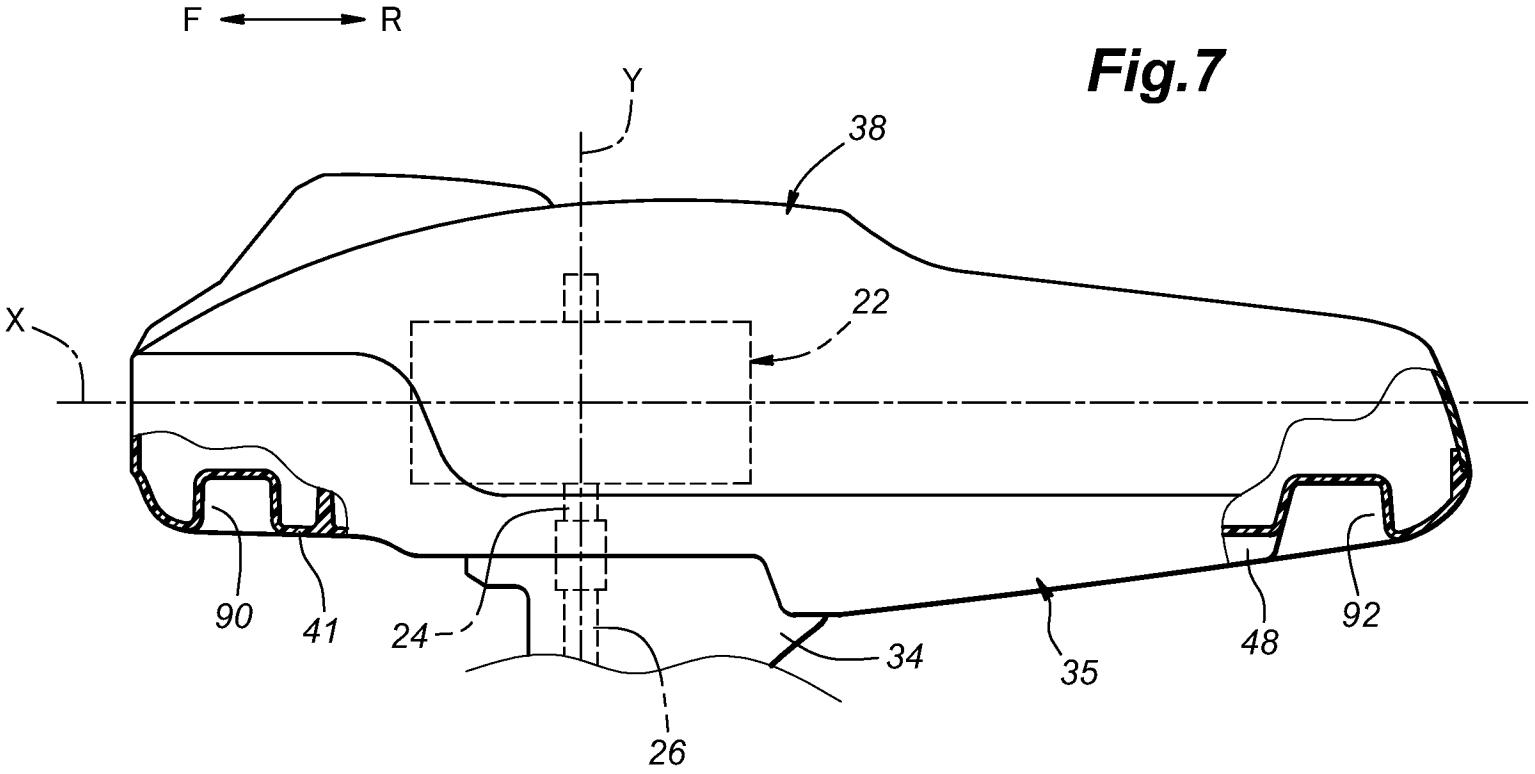
FIG. 7 is a side view of an upper part of the upper case and the lower case.

The outboard motor 10 may be required to be transported to and from the boat for the purposes of storage and maintenance from time to time. Considering the overall weight of the outboard motor 10, it may be appropriate to carry the outboard motor 10 by two persons. For this purpose, a front end part of the lower case 35 corresponding to the bottom wall of the tray part 41 is provided with a first recess 90 which is recessed upward as shown in FIG. 7. The first recess 90 is positioned on the lateral center line X extending in the longitudinal direction. Additionally, a rear end part of the lower case 35 is provided with a second recess 92 which is also recessed upward. The second recess 92 is positioned on the lateral center line X extending in the longitudinal direction. The rear end of the lower case 35 is positioned comparatively away from the center line Y of the drive shaft or the gravitational center which is located substantially on this center line Y, but the fins of the heat sink 48 help reinforcing the bending rigidity and strength of the rear end part of lower case 35.

Thus, the outboard motor 10 can be transported by two persons with ease. Since the two recesses 90 and 92 serving as the grips for transportation are positioned on the lateral central line X extending longitudinally, the outboard motor 10 can be carried by two persons in a stable manner. Furthermore, since the first and second recesses 90 and 92 are provided in structurally rigid and stable parts of the outboard motor 10, the outboard motor 10 can be handled in a favorable manner.

The present invention has been described in terms of a specific embodiment, but the present invention is not limited by such an embodiment and can be modified in various ways without departing from the scope of the present invention. For instance, the prime mover of the outboard motor 10 may also be an internal combustion engine.

Moreover, not all of the constituent elements shown in the above embodiments are essential to the broad concept of the present invention, and they can be appropriately selected, omitted and substituted without departing from the gist of the present invention. The contents of any cited references in this disclosure will be incorporated to the present application by reference.

The invention claimed is:

1. An outboard motor, comprising:

a housing main body configured to be attached to a hull of watercraft so as to be tilted upward;

a propulsion device attached to a lower part of the housing main body;

a lower case provided on an upper part of the housing main body;

an upper cover fixed to the lower case and defining a motor chamber jointly with the lower case;

a motor received in the motor chamber and configured to drive the propulsion device; and an outer shell at least partly covering the upper cover, wherein the upper cover is provided with a grip portion for the outboard motor, and the outer shell is provided with an opening that permits access to the grip portion, and wherein the upper cover includes a shelf having a lower surface to which a user grips when the outboard motor is required to be tilted up and serving as the grip portion, and a lower wall portion extending under the shelf in a spaced relationship to the shelf, and the lower wall portion extends rearward beyond a rear edge of the shelf.

2. The outboard motor according to claim 1, wherein the upper cover is provided with a bulge that bulges upward in a part thereof corresponding to the motor, and the shelf extending rearward from a rear end part of the bulge.

3. The outboard motor according to claim 2, wherein an upper surface of the shelf is substantially at a same elevation as an upper surface of the bulge.

4. The outboard motor according to claim 2, wherein a rib extends from a front end part of the shelf and a rear end part of the bulge.

5. The outboard motor according to claim 4, wherein the rib is one of a plurality of ribs extending vertically and in a fore and aft direction in a laterally spaced apart relationship, the laterally outermost ribs being longer in the fore and aft direction than the remaining ribs.

6. The outboard motor according to claim 4, wherein the rib has an upper edge which is substantially at a same elevation as an upper surface of the bulge.

7. The outboard motor according to claim 1, wherein the lower wall portion is continuously and smoothly connected to an outer profile of a part of the outer shell adjacent to the lower wall portion.

8. The outboard motor according to claim 1, wherein the upper cover is provided with a front wall extending substantially vertically downward from a front edge of the shelf, and a pair of side walls extending substantially vertically downward from either side edge of the shelf, the front wall and each side wall being connected by an oblique wall.

9. The outboard motor according to claim 1, wherein an operation panel including a push-button is provided on the upper cover.

10. The outboard motor according to claim 1, wherein the grip portion is positioned behind a gravitational center of the outboard motor.

* * * * *